US005421496A

United States Patent [19]

Korsinsky et al.

[11] Patent Number: 5,421,496

[45] Date of Patent: Jun. 6, 1995

[54] HANGING NURSING DEVICE

[76] Inventors: Gersh Korsinsky; Eduard Korsinsky; Michael Korsinsky, all of 1236 49th St., #4B, Brooklyn, N.Y. 11219

[21] Appl. No.: 907,626

[22] Filed: Jul. 2, 1992

Related U.S. Application Data

[63] Continuation-in-part of Ser. No. 630,327, Dec. 19, 1990, abandoned.

[51] Int. Cl.[6] ..... A45F 5/00

[52] U.S. Cl. ..... 224/148; 224/202; 248/102; 215/11.1

[58] Field of Search ..... 224/148, 202, 205; 215/11.1; 248/102, 103–107

[56] References Cited

U.S. PATENT DOCUMENTS

| | | | |
|---|---|---|---|
| 298,985 | 5/1884 | Kimball | 224/148 |
| 1,013,221 | 1/1912 | Roush | 248/102 |
| 1,369,928 | 3/1921 | Lockwood | 248/102 |
| 1,375,917 | 4/1921 | Paugh | 248/102 |
| 1,559,740 | 11/1925 | Cardarella | 248/102 |
| 2,399,320 | 4/1946 | Brose et al. | 248/102 |
| 2,494,632 | 1/1950 | Rodin | 224/148 |
| 2,579,701 | 12/1951 | Ridey et al. | 248/102 |
| 3,065,873 | 11/1962 | Plate | 215/11.1 |
| 3,620,491 | 11/1971 | Baclit | 224/148 |
| 4,537,341 | 8/1985 | Kelly | 224/148 |
| 4,793,533 | 12/1988 | Yang | 224/148 |
| 4,925,042 | 5/1990 | Chong | 224/148 |
| 4,994,076 | 2/1991 | Guss | 215/11.1 |
| 5,040,756 | 8/1991 | Via Cava | 248/103 |
| 5,049,127 | 9/1991 | Yen Tseng | 215/11.1 |

FOREIGN PATENT DOCUMENTS

| | | | |
|---|---|---|---|
| 55639 | 4/1911 | Switzerland | 248/102 |
| 1511 | of 1891 | United Kingdom | 248/102 |

*Primary Examiner*—Henry J. Recla
*Assistant Examiner*—Gregory M. Vidovich

[57] ABSTRACT

A nursing nipple or pacifier placed on a tube or pipe that distances the bottle, for hanging purposes, by time of liquid sucking, which is suitable for feeding devices.

1 Claim, 2 Drawing Sheets

HANGING NURSING DEVICE

This is a continuation in part application based on U.S. patent application Ser. No. 07/630,327, now abandoned, filed Dec. 19, 1990.

BACKGROUND OF INVENTION

The present invention is generally directed to nursing devices, particularly to a sucking device which allows a bottle to hang freely during the drinking process.

Presently the nipple is directly placed on the bottle (like a bottle cap) which requires holding the bottle close to mouth at drinking time.

The present invention differs from other sucking devices through the use of an adapter which extends or distances the nipple from the bottle by a flexible pipe which allows the bottle and the nipple to be independently located during drinking time.

SUMMARY OF THE INVENTION

Generally speaking, in accordance with the this invention, a nipple extension (adapter) is provided for distancing the nipple from the bottle with liquid. One end of the pipe is a nipple and the other end is any desirable type of connection to the bottle cap, or adapter to the bottle. The type of connection can be provided through additional designing.

Accordingly, an object of the present invention is to provide a nursing device which allows a bottle to hang freely during the drinking process.

Another object of the present invention is to provide an extension for distancing the nipple from the bottle.

Another object of the present invention is to provide an adapter pipe for flexible connection of the nipple to the bottle.

Still another object of the invention is to provide an extension which allows holding the bottle separately from the nipple.

The present invention teaches the basic principles of designing a nursing device which allows a bottle to hang freely during the drinking process. The type of nipple, bottle, or the type of the bottle connections features are not the subject matter of this invention and can be designed in any desirable way. Therefore, the drawing and the specification describes the nipple with the extension only.

The scope of the present invention will be indicated in the claim. The objects of the invention will be apparent from the specification and drawing.

DETAILED DESCRIPTION OF THE PREFERRED EMBODIMENTS

The nipple 4 is a sucking device or a pacifier which establishes a partial vacuum by sucking (breathing) or by inhalation thereby drawing liquid into the mouth.

The nipple extension 3 is a tube (pipe) extension connecting the nipple 4 to the bottle 2.

The liquid flow requires:

a) The upside down positioning of the bottle (liquid supplier) which produces pressure, the amount being dependent upon the positioning of the bottle.

b) A straw-like device which converts the established partial vacuum to sucking-in or sipping means.

The nipples and the extensions shape, size, material, etc. and the connections of the extension to the bottle are subject matter not discussed here and is left up to future desirable designing. The nipple connections on the bottle can be any type, depending on the bottle shape, etc. or the type of bottle holding devices. For example, the nipple to the bottle can be a cap which contains a part for holding, hanging or wearing the bottle. The nipple connections to the bottle (cap on the bottle) and the extension (pipe end) are left for future designing. Therefore, the drawings and the specification of the present invention teaches the basic principle of the nipple extensively and leaving the other subject matter for future designing. The present invention teaches the basic principal of the extension of a nipple which can be used in any type of nursing system for babies, cripples and old people.

The bottle held in place 1 is a holding device which is a field for future free designing because different uses require different ways of holding the bottle.

For example, the bottle may be used in a bed or in a carriage with a holding device as for example, clips, hangers, etc. It may be held for another individual or it may be self wearing which requires a holding device on a belt or pocket, etc. wherein all these require special designing based on the type of use.

The device held in place 1 can be a bottle part, a cap part, or a separate detail on the bottle, cap, or extension.

Figure 2:
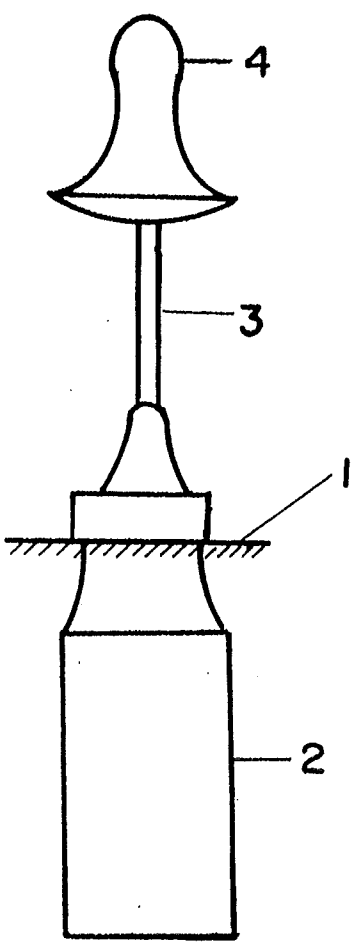
FIG. 2 illustrates the basic principles of the hanging nursing device in which the bottle is held right side up.
Figure 1:
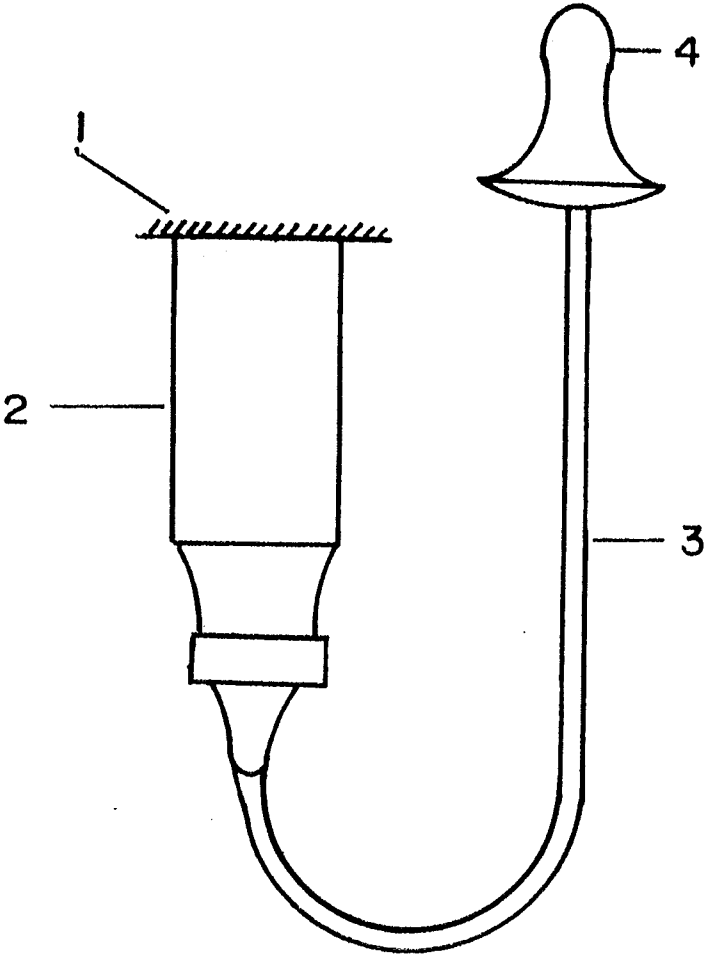
FIG. 1 illustrates the basic principles of a hanging nursing device in which the bottle is held in place upside-down.
Figure 3:
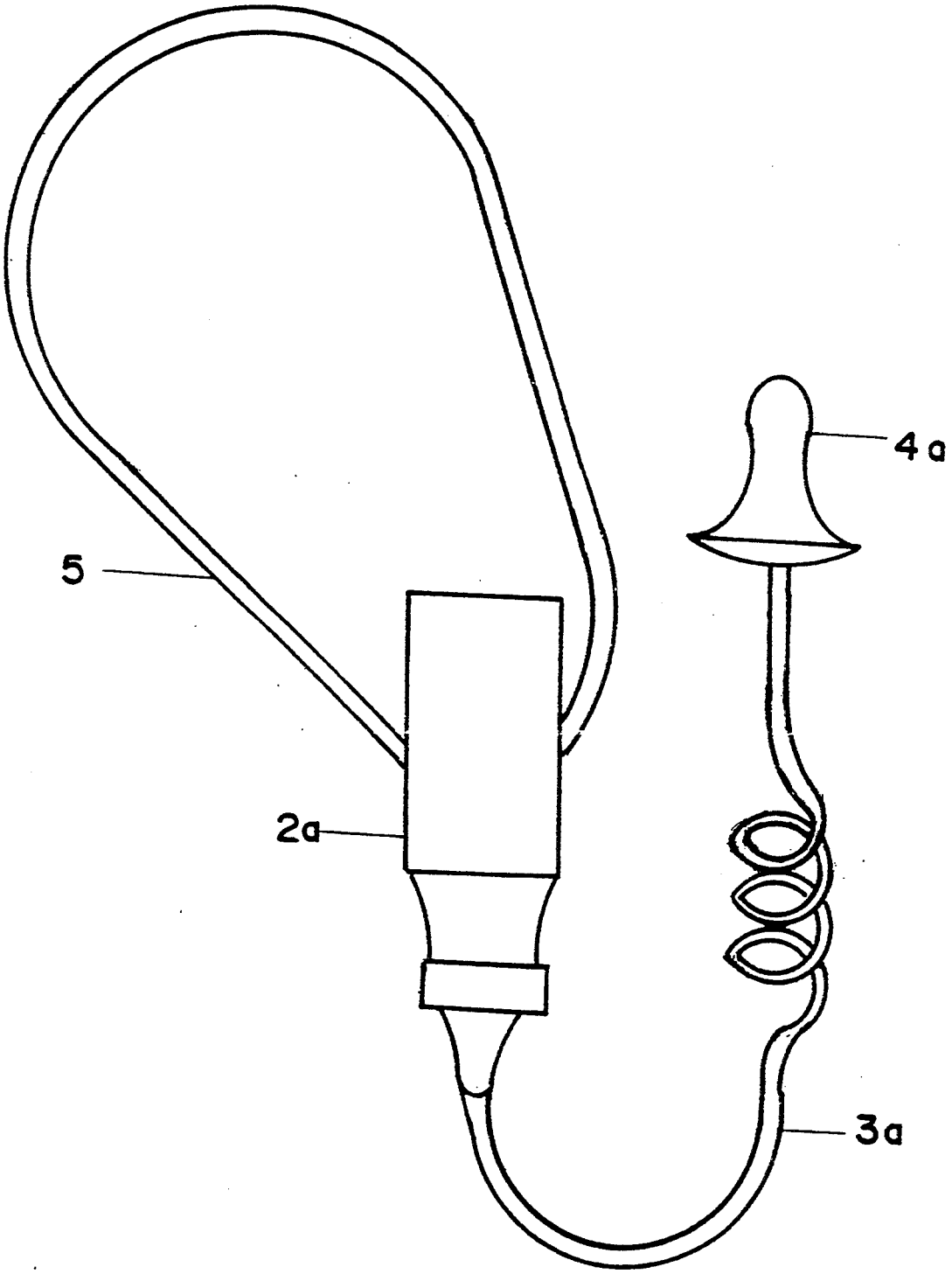
FIG. 3 illustrates a detailed principle of the nursing device in which the bottle is held upside-down.

In the embodiment illustrated in FIG. 3, a detailed nursing device is shown. The device includes a nipple 4*a*, an elongate, flexible tube 3*a* connecting the nipple 4*a* to a bottle 2*a* and a neck strap 5 connected to the bottle 2*a* for suspending the bottle 2*a* in a upside-down position. The tube 3*a* further includes a flexible extension means 3*b* which would allow a user of the device shown in FIG. 3 to adjustably position the nipple 4*a* relative to the bottle 2*a*.

We claim:

1. A holder for a baby bottle, said holder comprising:

strap having first and second ends, said strap adapted to be worn about the neck of an individual;

a baby bottle having a top and a bottom wherein said top includes an outlet;

said first and second ends of said strap being connected to said bottle such that said bottle is suspended in an upside down position when worn and wherein said top is positioned below said bottom;

an elongate, flexible robe, said tube having a first end adapted to be connected to said outlet and a second end having a nipple mounted thereon, said robe further including a flexible extension means on a portion of the tube intermediate said first and second ends of the tube for allowing a user to adjustably position said second end of said tube relative to said first end of said tube during use of the holder.

* * * * *